US011866905B2

(12) United States Patent
Unger et al.

(10) Patent No.: US 11,866,905 B2
(45) Date of Patent: Jan. 9, 2024

(54) LINKAGE FOR ARM ASSEMBLY WITH REDUCED WELD FATIGUE

(71) Applicant: Caterpillar Global Mining LLC, Tucson, AZ (US)

(72) Inventors: Daniel T. Unger, Yorkville, IL (US); Ramanagarajan Meenakshinathan, Chennai (IN); Kort C. Randall, Oro Valley, AZ (US)

(73) Assignee: Caterpillar Global Mining LLC, Tucson, AZ (US)

( * ) Notice: Subject to any disclaimer, the term of this patent is extended or adjusted under 35 U.S.C. 154(b) by 193 days.

(21) Appl. No.: 17/200,352

(22) Filed: Mar. 12, 2021

(65) Prior Publication Data

US 2022/0290398 A1 Sep. 15, 2022

(51) Int. Cl.
*E02F 3/38* (2006.01)
*E02F 3/36* (2006.01)

(52) U.S. Cl.
CPC ..... *E02F 3/3663* (2013.01); *E02F 3/38* (2013.01); *E02F 3/3636* (2013.01)

(58) Field of Classification Search
CPC ..... E02F 3/38
USPC ..... 414/722, 723
See application file for complete search history.

(56) References Cited

U.S. PATENT DOCUMENTS 5,995,893 A 11/1999 Lee
6,106,217 A * 8/2000 Knell ..... B66F 9/065 414/722
6,332,747 B1 12/2001 Lee
7,266,914 B2 * 9/2007 Grant ..... E02F 9/2883 37/444
8,342,789 B2 * 1/2013 Yasuda ..... E02F 9/0816 180/69.21
8,920,106 B2 12/2014 Seljestad
2021/0222405 A1 * 7/2021 Velde ..... E02F 9/2033

FOREIGN PATENT DOCUMENTS

CN 204690812 U 10/2015
CN 207109891 U 3/2018
CN 105804133 B * 11/2018 ..... E02F 3/3604
CN 105804133 B 11/2018
CN 111691473 A 9/2020
JP 2006152589 A 6/2006
JP 2019124071 A 7/2019
KR 20130087997 A 8/2013
KR 20150076377 A 7/2015

OTHER PUBLICATIONS

Written Opinion and International Search Report for Int'l. Patent Appln. No. PCT/US2021/019516, dated Jun. 20, 2022 (10 pgs).

* cited by examiner

*Primary Examiner* — Michael S Lowe

(57) ABSTRACT

A work machine includes a frame, a traction system supporting the frame, an arm assembly having a first end and a second end, the first end connected to the frame, an implement connected to the second end, and a linkage connecting the implement to the second end of the arm assembly. The linkage includes a pin-supporting section configured to accept a pin and a linking section attached to the pin-supporting section by a weld. The linking section includes a recess proximate to the weld.

17 Claims, 6 Drawing Sheets

LINKAGE FOR ARM ASSEMBLY WITH REDUCED WELD FATIGUE

TECHNICAL FIELD

The present disclosure relates generally to arm assemblies for work machines, and more specifically to linkages for arm assemblies.

BACKGROUND

Many work machines, such as hydraulic mining shovels, bulldozers, backhoes, front loaders, or excavators, utilize an implement to manipulate materials such as dirt, gravel, ore, stone, concrete, and the like. The implements may be provided in various forms and could include shovels, buckets, hydraulic hammers, fork lifts, blades, augers, movers, grapples, rippers, saws, and other similar tools. Such work machines are used in numerous industries, including, but not limited to, earth moving, construction, agriculture, and mining.

These work machines typically include a frame, an engine supported by the frame, and a traction system supporting the frame. Most work machines also include arm assemblies to position and move the implements. The arm assemblies typically have linkages that connect the arm assembly to the implement. The linkages are frequently composed of several separate pieces welded together.

However, in such a welded linkage, where the surface of the weld metal forming the weld bead intersects a surface of the structure, the high-temperature weld metal is restrained and rapidly cooled by the surrounding structure. As a result, residual tensile stresses can remain in the welded joint and the contact area between the weld material and the structure becomes a point where stress from external forces can concentrate. Therefore, a welded joint used in a metal structure may suffer from fatigue cracks occurring from the points of contact with the structure and developing into larger cracks and fractures due to repeated load. Further, residual stress and stress concentration impede the improvement of fatigue characteristics of a metal structure. Accordingly, these fatigue cracks occurring in such a welded joint have a serious effect on the reliability of the linkage, resulting in downtime to the work machine. The life of linkage components in a work machine may therefore be dictated by the fatigue strength of the welded joint.

There are a number of techniques that may increase the strength of a welded joint after welding. For example, as described in U.S. Pat. No. 8,776,564, an impact treatment near the toe of a weld reduces residual stress in the material and improves the fatigue characteristics. However, post-welding operations are limited in efficacy. Therefore, there remains a need for linkages with further reduced weld fatigue.

SUMMARY OF THE DISCLOSURE

According to one aspect of the present disclosure, a work machine is disclosed. The work machine includes a frame, a traction system supporting the frame, an arm assembly having a first end and a second end, the first end connected to the frame, an implement connected to the second end, and a linkage connecting the implement to the second end of the arm assembly. The linkage includes a pin-supporting section configured to accept a pin and a linking section attached to the pin-supporting section by a weld. The linking section includes a recess proximate to the weld.

According to another aspect of the present disclosure, a linkage for an arm assembly of a work machine is disclosed. The linkage includes a first pin-supporting section configured to accept a pin and a linking section. The linking section has a first end and a second end, the first end being attached to the pin-supporting section by a weld. The linking section further includes a first recess defined by the first end.

According to yet another aspect of the present disclosure, a method of producing a linkage for an arm assembly with reduced weld fatigue is disclosed. The method includes providing a pin-supporting section configured to accept a pin, providing a linking section having a first end, machining a recess in the linking section proximate to the first end, and welding the first end of the linking section to the pin-supporting section.

These and other aspects of the present disclosure will be more readily understood after reading the following detailed description in conjunction with the accompanying drawings.

DETAILED DESCRIPTION

Figure 1:
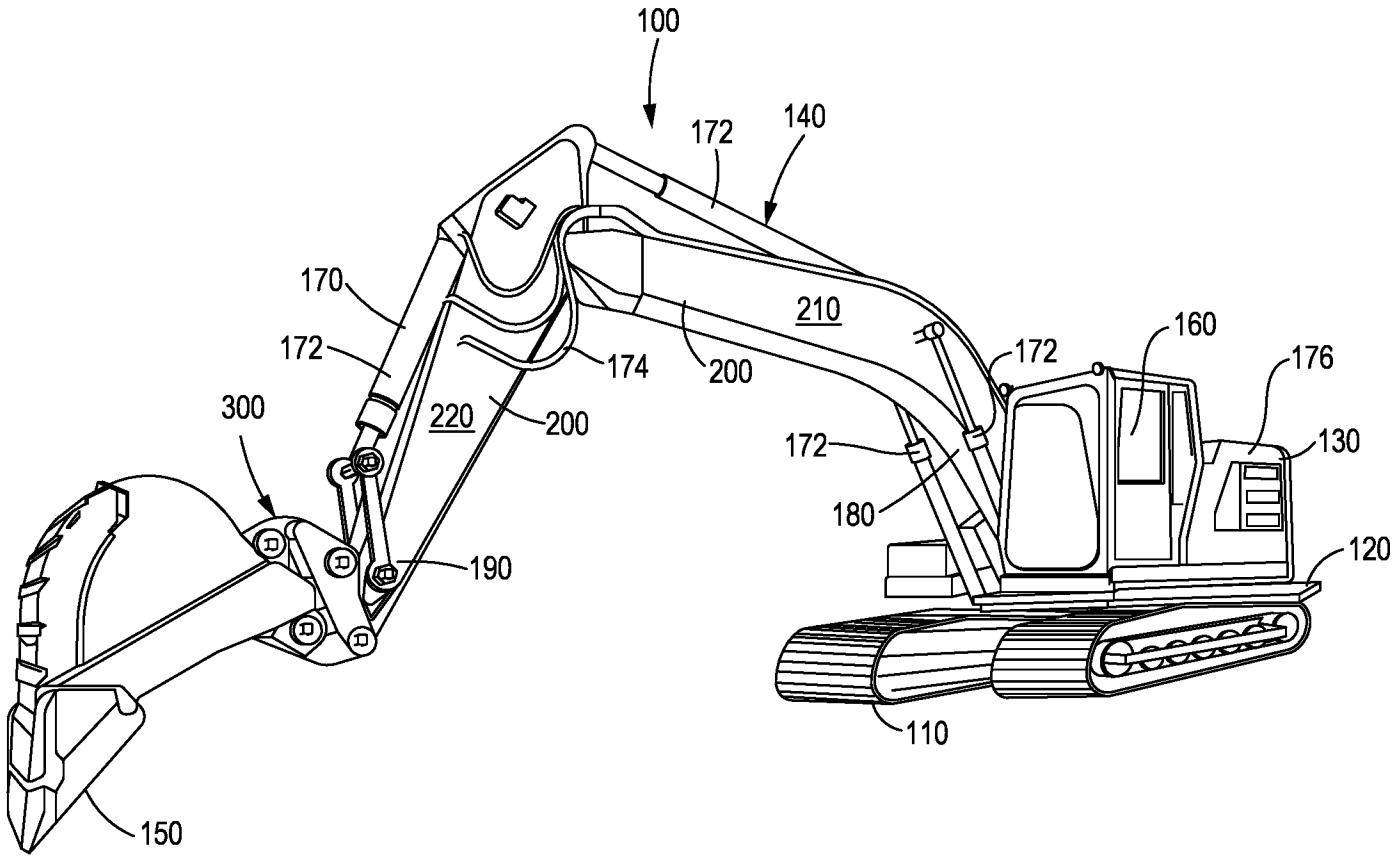
FIG. 1 is a perspective view of a work machine, according to one aspect of the present disclosure.

Referring now to the drawings and with specific reference to FIG. 1, a perspective view of an exemplary work machine is shown and referred to by reference numeral 100. The illustrated work machine is a hydraulic mining shovel, but the present disclosure may also apply to other types of work machines which utilize linkages in an arm assembly, including but not limited to excavators, backhoes, front loaders, and the like. Such work machines are used in a variety of industries such as construction, agriculture, mining, and the like.

The machine 100 includes a traction system 110, a frame 120, an engine, an arm assembly 140, and an implement 150. The traction system 110 supports the frame 120 and may include wheels, tracks, or other ground engaging devices which allow the machine 100 to move. The frame 120 supports the engine 130 and may be configured to rotate relative to the traction system 110. The frame 110 may also support an operator cab 160. The implement 150 as illustrated is a shovel bucket, but in some embodiments, other implements may be used, such as, but not limited to, hydraulic hammers, fork lifts, blades, augers, movers, grapples, rippers, saws, and the like.

The arm assembly 140 is configured to move the implement 150 through its required range of movement and may be powered by a hydraulic system 170.

The arm assembly 140 has a first end 180 connected to the frame 120 and a second end 190 connected to the implement 150. The arm assembly 140 may include a plurality of arm segments 200, such as a boom 210 and stick 220, and linkages 300 connecting the arm assembly 140 to the implement 150. In some embodiments, other linkages 300 (not shown) may connect arm segments 200 or connect the arm assembly 140 to the frame 120. The hydraulic system includes a plurality of cylinders 172 connected by a plurality of hoses 174 to a hydraulic fluid pump 176. The pump 176 moves hydraulic fluid through the hoses 174 to pressurize the cylinders 172. The hydraulic cylinders extend and retract based on commands from an operator to move the segments of the arm assembly 140 and the implement as desired.

Figure 2:
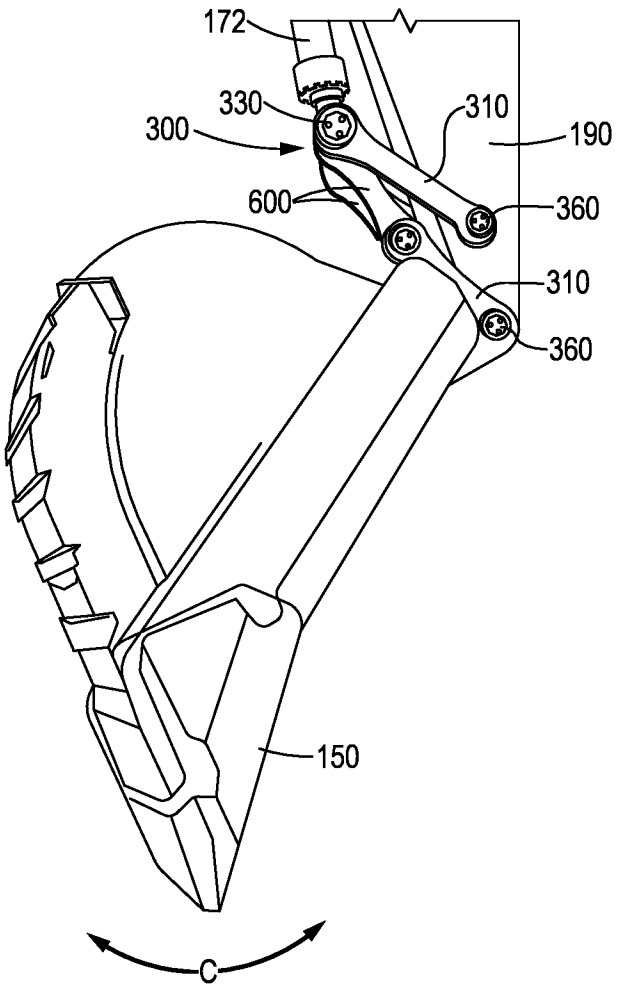
FIG. 2 is an enlarged perspective of a portion of an arm assembly and an implement of the work machine of FIG. 1, according to one aspect of the present disclosure.
Figure 3:
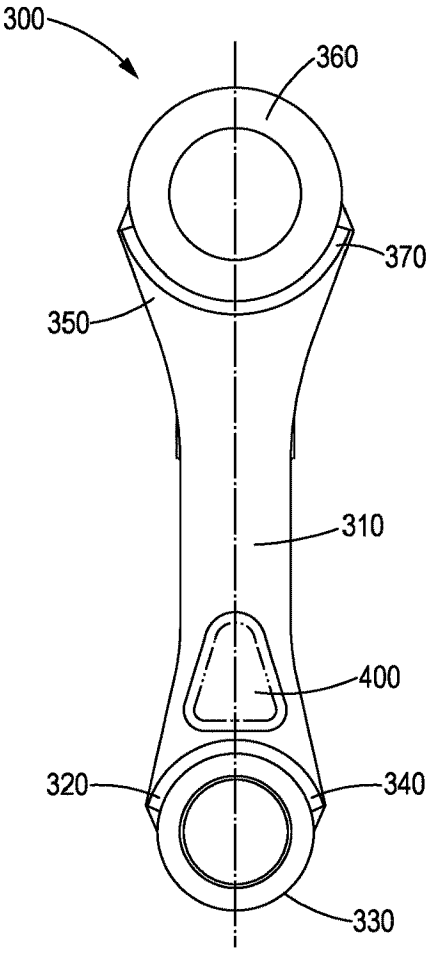
FIG. 3 is a side view of a linkage for an arm assembly, according to one aspect of the present disclosure.
Figure 7:
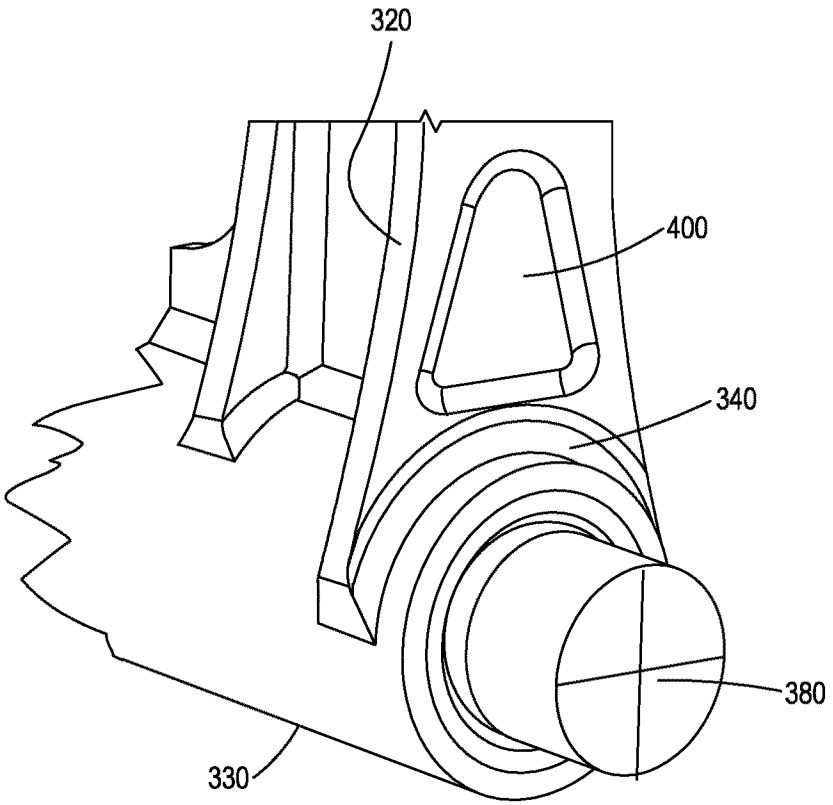
FIG. 7 is a enlarged perspective of one portion of FIG. 6, according to one aspect of the present disclosure.

FIG. 2 is a close up of linkages 300 connecting the arm assembly 140 to the implement 150. The linkages 300 help control the movement of the implement 150 as the hydraulic cylinder 172 extends and retracts. The linkages 300 are configured such that the movement of the hydraulic cylinder 172 rotates the implement through curve C. As also shown in FIG. 3, each linkage 300 includes a linking section 310 with a first end 320 connected to a first pin-supporting section 330 by a first weld 340 and a second end 350 connected to a second pin-supporting section 360 by a second weld 370. Each pin-supporting section 330, 360 is configured to accept a pin 380 (as shown in FIG. 7) and may contain bearings or other mechanisms to allow free movement of the linkage 300.

The linkages 300, as part of the arm assembly 140, must contend with significant strains and stresses from regular use. Over time and with continued use, these strains can cause inefficient operation and ultimately failure of the linkage 300, and in particular in the welds 340, 370. The present disclosure therefore sets forth the structure and methods for avoiding such occurrences and thus minimizing work machine downtime.

Figure 4:
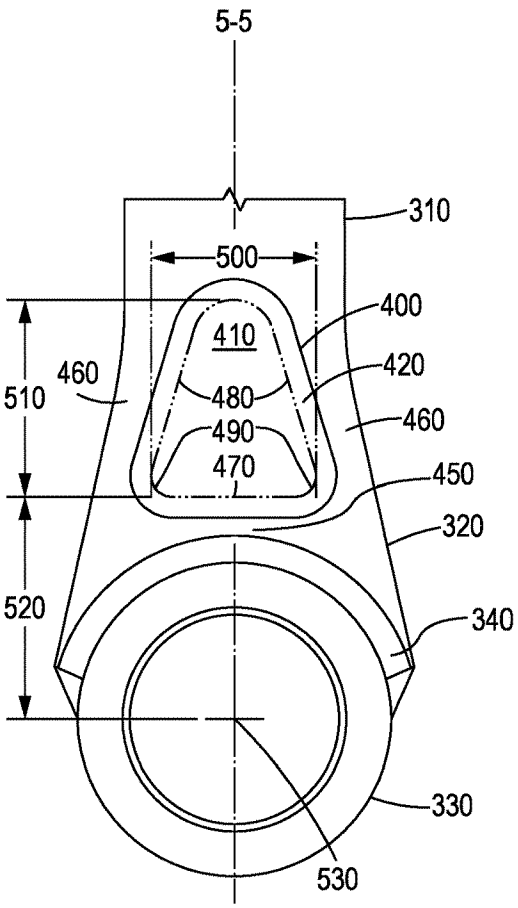
FIG. 4 is an enlarged side view of one portion of FIG. 3, according to one aspect of the present disclosure.
Figure 5:
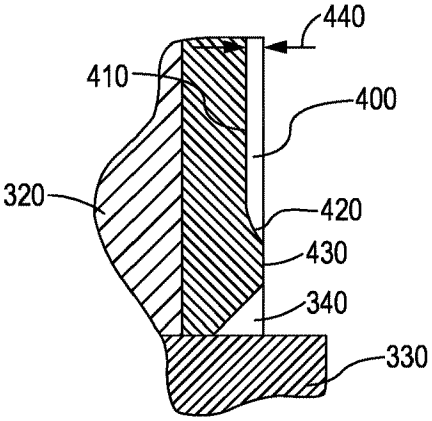
FIG. 5 is a cross-sectional view of the linkage of FIG. 4 taken along line 5-5 of FIG. 4, according to one aspect of the present disclosure.

More specifically, as shown in FIGS. 3-7, and in particular in FIGS. 4 and 5, the present disclosure includes a recess 400 configured to reduce weld fatigue. Such a recess 400 does not require changing the overall geometry of the linkage or extensive modification of the linking section. The recess allows the linking section to bend and flex and thus redirect and absorb stresses and strains rather than fatiguing the weld. Although only a single recess is shown in the figures, additional recesses may be located proximate to the second end of the linking body, or on an opposite side of the linking body to the recess described above.

As best shown in FIGS. 4 and 5, the recess 400 is a shallow flattened depression formed by a recess face 410 and a transition face 420. The recess 400 is machined into a surface 430 of the linking section 310 proximate to, but not in contact with, the weld 340 at the first end 320 of the linking section 310. The recess face 410 is on the same plane as the surface 430 of the linking section 310 at a depth 440 relative to the surface 430, as shown in FIG. 5. The transition face 420 is a rounded surface extending from the recess face 410 to the surface 430 of the linking section 310 all the way around the recess 400.

On each side of the recess 400 is a non-recessed region or rib on the same plane as the rest of the surface 430 of the linking section 310. The surface between the recess and the weld is a weld rib 450. A side rib 460 is located between each side of the recess 400 and the respective side of the linking section 310. These ribs 450, 460 provide strength to the linking section 310 while permitting the recess 400 to flex and absorb strain.

In the depicted embodiment, the recess 400 is centered within the first end 320 of the linking section 310 but does not extend entirely across the surface 430 of the linking section 310. However, the recess may be off-center if the shape of the linking section 310 results in off-center stresses.

The shape of the recess 400 is configured to redirect stresses around and away from the weld 340. The recess 400 may be any triangular or rectangular shape with a near edge 470 (the edge closest to the weld 340) and side edges 480 extending away from the weld 340. Each edge 470, 480 is defined as the end of the recess face 410, not where the transition face 420 meets the surface 430 of the linking section 310. The shape of the recess 400 preferably follows the shape of the linking section 310. For example, the recess 400 shown in FIG. 3 has a triangular shape which fits the tapered shape of the linking section 310, in contrast, if the linking section 310 had a continuous width, a rectangular recess 400 may be more advantageous. A width 500 of the recess is defined by the length of the near edge 470 and limited by the side ribs 460.

In the depicted embodiment, the near edge 470 and the side edges 480 meet at near edge corners 490. The near edge 470 runs approximately perpendicular to a longitudinal axis of the linkage 300 to avoid focusing stresses in either of the near edge corners 490. The near edge corners 490 are rounded with a radius as small as reasonable machining methods allow. This aids in directing the strain into the recess 400 and away from the weld 340. As such, a smaller radius is preferred. For example, if the near edge 470 has a width 500 of 95 mm, the radius of the near edge corners 490 may be in the range of 10-20 mm.

The transition face 420 from the recess face 410 towards the surface of the linking section 310 is rounded with an internal radius. The internal radius should be as large as is reasonable given the dimensions of the linking section 310, reasonable machining methods, and the material properties of the linking section 310. For example, if the recess depth 470 is 6.6 mm, the internal radius of the transition face 420 may be in the range of 20-30 mm. If the internal radius of the transition face 420 is smaller, the stresses may be directed deeper within the linking section 310 away from the surface. As such, a larger radius is preferred.

An appropriate width 500 is dependent on the dimensions of the linkage and the properties of the material from which the linkage is manufactured. For example, the linking section may be made of a mild steel (a low carbon steel with a carbon content of less that 0.30% by weight). If the linking section 310 is made of mild steel and has a width of 210 mm at the location of the near edge 470, the width 500 of the recess 400 may be in the range of 125 mm or 60 percent of the total width of the linking section 310. If the width 500 is too small, then too much of the load will be allowed into the center section of the weld 340, where the stress is the highest. Alternatively, if the width 500 is too large, then the linking section 310 will not be able to provide enough stiffness and stresses in other locations mill increase.

The depth 440 should also be sufficient to allow a small amount of flexibility but not sacrifice strength. As such the appropriate depth will depend on the material and dimensions of the linking section 310. For example, in a linking section made of a mild steel with a thickness of 30 mm, the depth may be in the range of 5-20 mm or 17-67 percent of the total thickness of the linking section. The depth 440 and the location of the recess 400 are also linked. The location of the recess 400 is measured by a pin distance 520, defined as the distance between a center point of the pin supporting section 530 and the near edge 470. As the pin distance 520 increases, and therefore the recess 400 moves further from the weld 340, the recess depth 440 should also be increased to maintain the same level of efficacy. Furthermore, a higher or lower strength material would impact how much stress is in the recess, which is controlled by the depth 440, the internal radius of the transition face 420, and the pin distance 520. Finite element analysis optimization may be utilized to adjust the width, depth, radius, and pin distance to optimized the dimensions for the given material and linkage.

Figure 6:
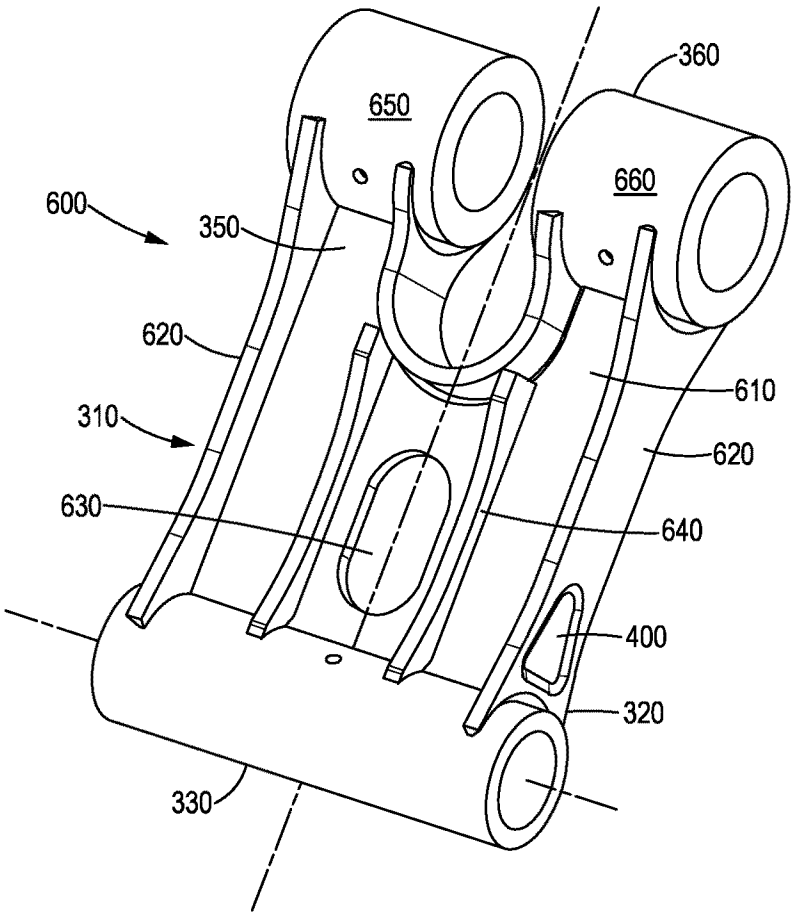
FIG. 6 is a perspective view of a H-link linkage for an arm assembly, according to one aspect of the present disclosure.

In some embodiments, the linkage may be an H-link. One example of an H-link is shown in FIG. 6 and referred to as reference numeral 600. As shown in FIG. 2, an H-link 600 provides a sturdy connection between the arm assembly 140, the hydraulic cylinder 172, and the implement 150. Furthermore, the H-link 600 and the other linkages 300 work together to move the implement 150 along rotational line C as the hydraulic cylinder 172 extends or retracts. H-links are commonly used in work machines 100 in which the implement is a bucket or other similar implement requiring rotation, such as a blade, or shovel.

Similar to the linkage 300 shown in FIG. 6, the H-link 600 includes a linking section 310 with a first end 320 welded to a first pin-supporting section 330 and a second end 350 welded to a second pin-supporting section 360. However, the linking section of the H-link 600 includes a linking body 610 which connects two side plates 620 attached to each side of the linking body 610. The side plates 620 extend from the first pin-supporting section 330 to the second pin supporting section 360. The linking body 610 may also include cutouts 630 and/or supports 640. The second pin-supporting section may be split into a left 650 and right portion 660 to permit attachment of other components of the work machine 100.

In embodiments in which the linkage is an H-link 600, the recess 400 is located in an externally facing surface of the side plate 620. A close up of this portion of the H-link 600 is shown in FIG. 7. Additional recesses 400 may be located on internal surfaces of the side plate 620 or supports 640. Further, as previously described, although only one recess 400 proximate the first end 320 is shown in FIGS. 6 and 7, additional recesses 400 may be located proximate the second end 350 and on both sides of the linking section 310.

In some H-link 600 embodiments, the recess 400 may have a depth 440 of 6.6 mm, a width 500 of 125 mm, a height 510 of 150 mm, and a pin distance 530 of 171 mm, although these are only examples and other dimensions are possible. The internal radius of the transition face 420 may be 25 mm. The radius of the near edge corners 490 may be 15 mm. However, as previously discussed, each of these dimensions may be adjusted based on the material, machining restrictions, and the specific dimensions of the linkage.

Optionally, additional recesses 400 may be machined into the linking section if desired. For example, a recess may be desired for each weld that is under strain and therefore a second recess (not shown) may be machined proximate to the second end 350. Moreover, if the linking section is not an H-link, a recess on an opposing surface of the linking section may be advisable. Alternatively, if the linkage is an H-link, a recess may be desired on each side plate adjacent to the weld at each end of the pin section.

INDUSTRIAL APPLICABILITY

In general, the present disclosure finds application in many different industries, including, but not limited to, earth moving equipment, construction, agriculture, mining, and the like. More specifically, a linkage with a weld fatigue recess may be applied in any work machine 100 with an arm assembly 140 requiring linkages 300 with welds such as hydraulic mining shovels, excavators, backhoes, front loaders, and the like. In each of these types of work machines 100, welded linkages 300 in the arm assembly 140 may experience significant stresses and strains during normal use. The welded connections in the linkages 300 present a potential failure point. The present disclosure therefore includes a linkage 300 with a recess 400 configured to reduce the stress on the weld. The foregoing sets forth said structure and the method of producing said linkage 300 is shown in FIG. 7, referred to by reference numeral 800.

Figure 8:
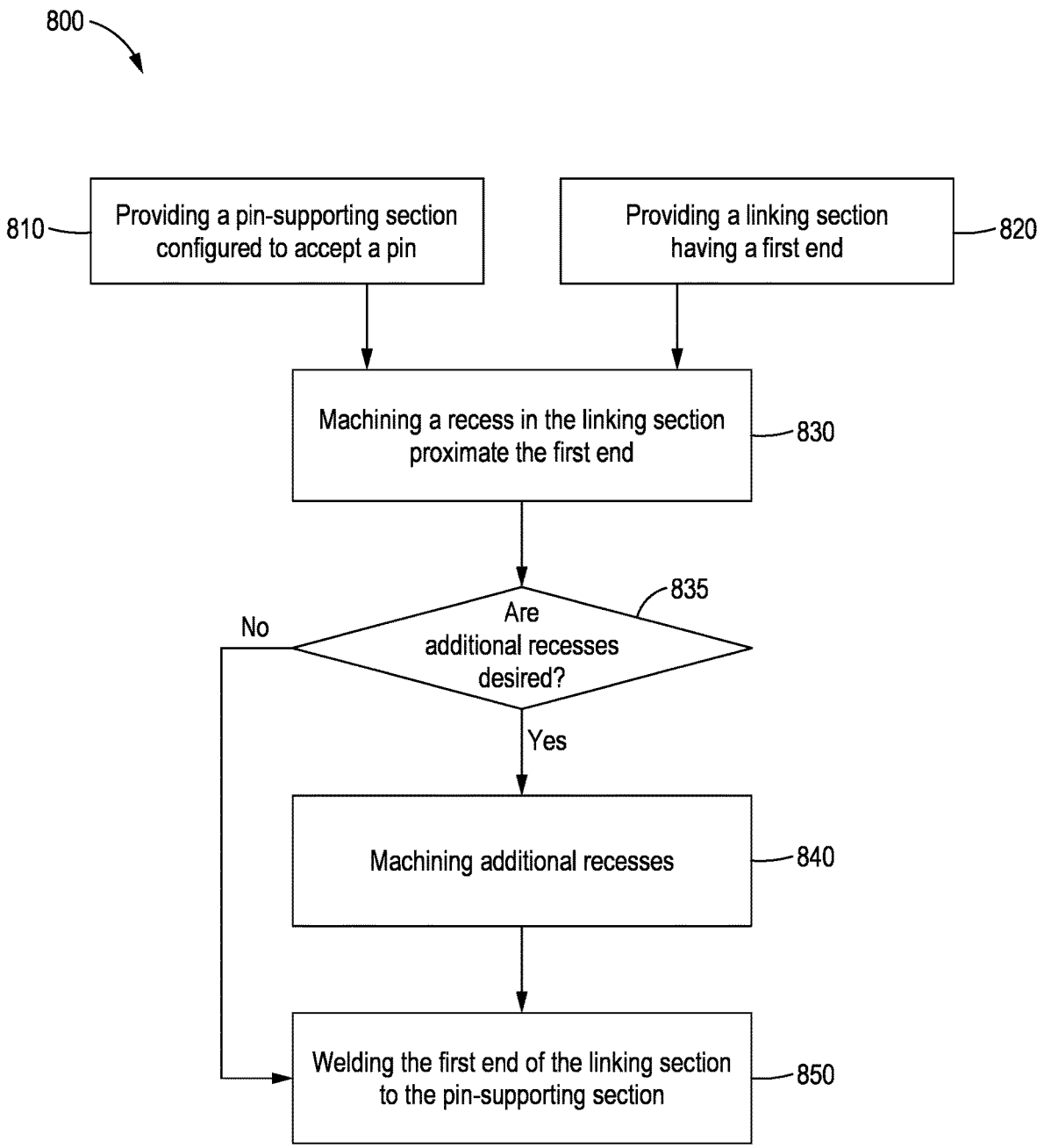
FIG. 8 is a flow chart for a method of producing a linkage with reduced weld fatigue, according to one aspect of the present disclosure.

Turning now to FIG. 8, the method 800 begins by providing a first pin-supporting section 330 (block 810) and a linking section 310 (block 820). The first pin-supporting section 330 is a cylindrical tube configured to accept a pin 380 and may contain bearings or other mechanisms for improving movement. A second pin-supporting section 360 may also be provided. The linking section 310 has a first end 320 and a second end 350.

In order to reduce fatigue in the linkage 300 during use, a recess 400 is machined in the linking section proximate to the first end (block 830). As discussed in detail previously, the recess 400 is a shallow flattened depression machined into a surface 430 of the linking section 310 proximate to, but not in contact with, the weld 340 at the first end 320 of the linking section 310. If the linkage is an embodiment in which the linking section 310 includes a side plate 620, such as the previously discussed H-link, the recess 400 may be machined into an external surface of the side plate 620.

Further, optionally, additional recesses 400 may be machined into the linking section if desired, as shown in decision 835 and block 840. For example, a recess may be desired for each weld that is under strain and therefore a second recess (not shown) may, be machined proximate to the second end 350. In addition, if the linkage is an H-link, a recess may be desired on each side plate adjacent to the weld at each end of the pin section. Moreover, if the linking section is thicker, a recess may be located on an opposing side of the linking section.

Finally, the first end 320 of the linking section 310 is welded to the first pin-supporting section 330 (block 850). The welding may be accomplished by any method suitable to the materials used. The second pin-supporting section 360 may be welded to the second end 350.

Figure 9:
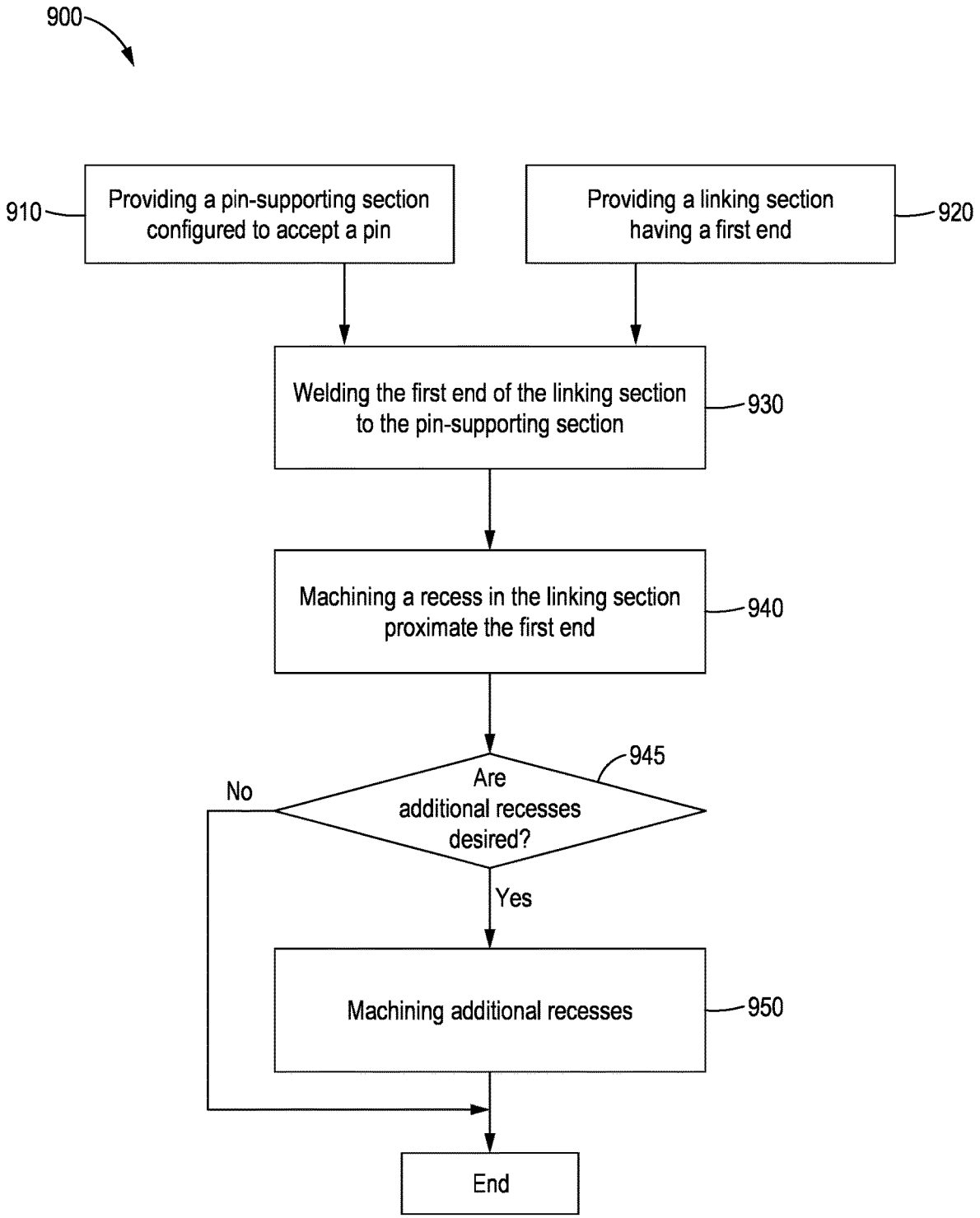
FIG. 9 is a flow chart for a method of producing a linkage with reduced weld fatigue, according to one aspect of the present disclosure.

An alternative order of steps is depicted in FIG. 9. In this method 900, the steps of providing a pin-supporting section 330 and providing a linking section 310 (block 910 and 920) remain the same. However, in this alternative, the first end 320 may be welded to the first pin-supporting section 330 (block 930) prior to the machining steps. After welding, a first recess is machined (block 940). Finally, if desired for any of the reasons previously described, additional recesses may be machined (block 950). Welding the linking section and the pin-supporting section first may be more expensive due to increased machining complexity of the assembled linkage 300. However, in some cases, it may be advantageous to align the recess 300 with the pin-supporting section 330 after assembly.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A work machine, comprising:

a frame;

a traction system supporting the frame;

an arm assembly having a first end and a second end, the first end being connected to the frame, an implement connected to the second end; and a linkage connecting the implement to the second end of the arm assembly, the linkage having a pin-supporting section configured to accept a pin, and a linking section attached to the pin-supporting section by a weld, the linking section formed from a linking body with a separate side plate attached to each side of the linking body, the linking section having a recess proximate the weld being located on an outside surface of the separate side plate, the recess having a height extending in the same direction of the linking section, and the height is less than 50% of the overall length of the linking section.

2. The work machine of claim 1, wherein a weld rib is located between the recess and the weld and a side rib is located on each side of the recess.

3. The work machine of claim 1, wherein the recess has a triangular shape.

4. The work machine of claim 1, wherein the recess is formed by a flat recess face and a curved transition face.

5. The work machine of claim 4, wherein the flat recess face creates a plate parallel to a plane created by a surface of the linking section.

6. The work machine of claim 1, wherein the linkage is an H-link.

7. A linkage for an arm assembly of a work machine, comprising a first pin-supporting section configured to accept a pin; and a linking section having a first end and a second end, the first end attached to the pin-supporting section by a weld, the linking section formed from a linking body with a separate side plate attached to each side of the linking body, and a first recess defined by the first end, the first recess being located on an outside surface of the separate side plate, the first recess having a height extending in the same direction of the linking section, and the height is less than 50% of the overall length of the linking section.

8. The linkage of claim 7, wherein a weld rib is located between the first recess and the weld and a side rib is located on each side of the recess.

9. The linkage of claim 7, further comprising a second pin-supporting section connected to the second end by a weld, and a second recess proximate to the second end.

10. The linkage of claim 7, wherein the recess has a triangular shape.

11. The linkage of claim 10, wherein the recess is formed by a flat recess face and a curved transition face.

12. A method of producing a linkage for an arm assembly with reduced weld fatigue, comprising:

providing a first pin-supporting section configured to accept a pin;

providing a linking section having a first end, the linking section formed from a linking body with a separate side plate attached to each side of the linking body;

machining a first recess in an outward facing side surface of the separate side plate proximate the first end such that the first recess has a height less than 50% of the overall length of the linking section; and welding the first end of the linking section to the first pin-supporting section.

13. The method of claim 12, wherein a weld rib is located between the first recess and the first end and a side rib is located on each side of the first recess.

14. The method of claim 12, wherein the first recess has a triangular shape.

15. The method of claim 12, wherein the first recess is formed by a flat recess face and a curved transition face.

16. The method of claim 15, wherein the flat recess face creates a plate parallel to a plane created by a surface of the linking section.

17. The method of claim 12, wherein the linking section has a second end, the method further comprising:

providing a second pin-supporting section, machining a second recess in the linking section proximate the second end, and welding the second end of the linking section to the second pin-supporting section.

* * * * *